US006874494B2

(12) United States Patent
Scherer et al.

(10) Patent No.: US 6,874,494 B2
(45) Date of Patent: Apr. 5, 2005

(54) BLOCK SPLITTING ASSEMBLY AND METHOD

(75) Inventors: Ronald J. Scherer, Oak Park Heights, MN (US); David Matthew LaCroix, Circle Pines, MN (US); Glenn C. Bolles, Edina, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/103,155

(22) Filed: Mar. 20, 2002

(65) Prior Publication Data

US 2003/0180099 A1 Sep. 25, 2003

(51) Int. Cl.[7] ..... B28D 1/26; B28D 1/32; B28D 5/00

(52) U.S. Cl. ..... 125/40; 125/23.01; 125/24; 125/30.01

(58) Field of Search ..... 125/23.01, 40; 81/463; 32/11

(56) References Cited

U.S. PATENT DOCUMENTS

| | | | | | |
|---|---|---|---|---|---|
| 470,788 | A | * | 3/1892 | Devine | 125/40 |
| 806,951 | A | | 12/1905 | Bryning | |
| 1,534,353 | A | | 4/1925 | Besser | |
| 1,893,430 | A | | 1/1933 | McKenzie | |
| 2,593,606 | A | | 4/1952 | Price | |
| 2,746,447 | A | | 5/1956 | Petch | |
| 2,775,236 | A | | 12/1956 | Blum | |
| 2,867,205 | A | * | 1/1959 | Vesper | 125/23.01 |
| 2,881,753 | A | | 4/1959 | Entz | |
| 2,925,080 | A | | 2/1960 | Smith | |
| 3,120,842 | A | | 2/1964 | Cox et al. | |
| 3,392,719 | A | | 7/1968 | Clanton et al. | |
| 3,559,631 | A | | 2/1971 | Mangis | |
| 3,809,049 | A | | 5/1974 | Fletcher et al. | |
| 4,250,863 | A | | 2/1981 | Gagnon et al. | |
| 4,335,549 | A | | 6/1982 | Dean, Jr. | |
| 5,066,070 | A | | 11/1991 | Clarke | |
| 5,152,275 | A | * | 10/1992 | Landhuis | 125/12 |
| 5,413,086 | A | | 5/1995 | Trudeau | |
| 5,662,094 | A | | 9/1997 | Giacomelli | |
| 5,687,515 | A | * | 11/1997 | Rodrigues et al. | 52/103 |
| 5,722,386 | A | | 3/1998 | Fladgard et al. | |
| 5,762,061 | A | * | 6/1998 | Bevan | 125/23.01 |
| 6,050,255 | A | | 4/2000 | Sievert | |
| 6,102,026 | A | * | 8/2000 | Fladgard et al. | 125/23.01 |
| 6,321,740 | B1 | * | 11/2001 | Scherer et al. | 125/40 |
| 6,401,707 | B1 | * | 6/2002 | Fladgard et al. | 125/23.01 |
| D464,145 | S | | 10/2002 | Scherer et al. | |
| 6,460,534 | B1 | * | 10/2002 | Vasquez et al. | 125/23.01 |
| 2002/0015620 | A1 | | 2/2002 | Woolford et al. | |
| 2002/0092257 | A1 | * | 7/2002 | Scherer et al. | 52/596 |
| 2003/0180099 | A1 | * | 9/2003 | Scherer et al. | 405/284 |

FOREIGN PATENT DOCUMENTS

| | | |
|---|---|---|
| EP | 0 294 267 A1 | 12/1988 |
| GB | 1 245 921 | 9/1971 |
| GB | 1 509 747 | 5/1978 |

OTHER PUBLICATIONS

"Fairlane Positioning and Workholding Products," http: www.fairlaneprod.com.index.htm, Fairlane Products Inc., 2 pages (Date Printed Nov. 15, 2001).

Copy of patent application Ser. No. 09/691,864, entitled "Block Splitting Assembly and Method," filed Oct. 19, 2000.

Copy of patent application Ser. No. 09/884,795, entitled "Block Splitting Assembly and Method," filed Jun. 19, 2001.

* cited by examiner

*Primary Examiner*—Carl D. Friedman
*Assistant Examiner*—Kevin McDermott
(74) *Attorney, Agent, or Firm*—Merchant & Gould P.C.

(57) ABSTRACT

A masonry block that is produced from a workpiece that is split in a block splitting assembly which uses engagement surfaces that are enhanced with, for example, alternating ridges and valleys, preferably in combination with workpiece-engaging projections, to supplement or replace the action of the splitting blade in splitting and dressing the workpiece.

36 Claims, 11 Drawing Sheets

BLOCK SPLITTING ASSEMBLY AND METHOD

FIELD OF THE INVENTION

The invention relates generally to the manufacture of masonry blocks. More specifically, it relates to equipment and processes for the creation of decorative faces on masonry blocks. Even more specifically, the invention relates to equipment and processes for producing irregular textures and the appearance of weathered or rocklike edges on masonry blocks, as well as to masonry blocks that result from such equipment and processes.

BACKGROUND OF THE INVENTION

It has become rather common to use concrete masonry blocks for landscaping purposes. Such blocks are used to create, for example, retaining walls, ranging from comparatively large structures to small tree ring walls and garden edging walls. Concrete masonry blocks are made in high speed production plants, and typically are exceedingly uniform in appearance. This is not an undesirable characteristic in some landscaping applications, but it is a drawback in many applications where there is a demand for a more "natural" appearance to the material used to construct the walls and other landscaping structures.

One way to make concrete masonry blocks less uniform, and more "natural" appearing, is to use a splitting process to create an irregular front face, often referred to as a "rock-face", on the block. In this process, as it is commonly practiced, a large concrete workpiece which has been adequately cured is split or cracked apart to form two blocks. The resulting blocks have faces along the plane of splitting or cracking that are textured and irregular. This process of splitting a workpiece into two masonry blocks to create an irregular rock-like appearance on the exposed faces of the blocks is shown, for example, in Besser's U.S. Pat. No. 1,534,353, which discloses the manual splitting of blocks using a hammer and chisel.

Automated equipment to split block is well-known, and generally includes splitting apparatus comprising a supporting table and opposed, hydraulically-actuated splitting blades. A splitting blade in this application is typically a substantial steel plate that is tapered to a relatively narrow or sharp knife edge. The blades typically are arranged so that the knife edges will engage the top and bottom surfaces of the workpiece in a perpendicular relationship with those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cracks), generally along the plane of alignment of the blades.

These machines are useful for the high-speed processing of blocks. They produce an irregular, rock-face finish on the blocks. No two faces resulting from this process are identical, so the blocks are more natural in appearance than standard, nonsplit blocks. However, the edges of the faces resulting from the industry-standard splitting process are generally well-defined, i.e., regular and "sharp", and the non-split surfaces of the blocks, portions of which are sometimes in view in landscape applications, are regular, "shiny" and non-textured, and have a "machine-made" appearance.

These concrete masonry blocks can be made to look more natural if the regular, sharp edges of their faces are eliminated.

One known process for eliminating the regular, sharp edges on concrete blocks is the process known as tumbling. In this process, a relatively large number of blocks are loaded into a drum which is rotated around a generally horizontal axis. The blocks bang against each other, knocking off the sharp edges, and also chipping and scarring the edges and faces of the blocks. The process has been commonly used to produce a weathered, "used" look to concrete paving stones. These paving stones are typically relatively small blocks of concrete. A common size is 3.75 inches wide by 7.75 inches long by 2.5 inches thick, with a weight of about 6 pounds.

The tumbling process is also now being used with some retaining wall blocks to produce a weathered, less uniform look to the faces of the blocks. There are several drawbacks to the use of the tumbling process in general, and to the tumbling of retaining wall blocks, in particular. In general, tumbling is a costly process. The blocks must be very strong before they can be tumbled. Typically, the blocks must sit for several weeks after they have been formed to gain adequate strength. This means they must be assembled into cubes, typically on wooden pallets, and transported away from the production line for the necessary storage time. They must then be transported to the tumbler, depalletized, processed through the tumbler, and recubed and repalletized. All of this "off-line" processing is expensive. Additionally, there can be substantial spoilage of blocks that break apart in the tumbler. The tumbling apparatus itself can be quite expensive, and a high maintenance item.

Retaining wall blocks, unlike pavers, can have relatively complex shapes. They are stacked into courses in use, with each course setback a uniform distance from the course below. Retaining walls must also typically have some shear strength between courses, to resist earth pressures behind the wall. A common way to provide uniform setback and course-to-course shear strength is to form an integral locator/shear key on the blocks. Commonly these keys take the form of lips (flanges) or tongue and groove structures. Because retaining wall blocks range in size from quite small blocks (e.g. about 10 pounds and having a front face with an area of about 0.25 square foot) up to quite large blocks having a front face of a full square foot and weighing on the order of one hundred pounds, they may also be cored, or have extended tail sections. These complex shapes cannot survive the tumbling process. Locators get knocked off, and face shells get cracked through. As a consequence, the retaining wall blocks that do get tumbled are typically of very simple shapes, are relatively small, and do not have integral locator/shear keys. Instead, they must be used with ancillary pins, clips, or other devices to establish setback and shear resistance. Use of these ancillary pins or clips makes it more difficult and expensive to construct walls than is the case with blocks having integral locators.

Another option for eliminating the sharp, regular edges and for creating an irregular face on a concrete block is to use a hammermill-type machine. In this type of machine, rotating hammers or other tools attack the face of the block to chip away pieces of it. These types of machines are typically expensive, and require space on the production line that is often not available in block plants, especially older plants. This option can also slow down production if it is done "in line", because the process can only move as fast as the hammermill can operate on each block, and the blocks typically need to be manipulated, e.g. flipped over and/or rotated, to attack all of their edges. If the hammermill-type process is done off-line, it creates many of the inefficiencies described above with respect to tumbling.

Yet another option for creating a more natural block face appearance and eliminating the sharp, regular edges of concrete blocks is disclosed in commonly assigned, copending U.S. patent application Ser. No. 09/884,795 (filed Jun. 19, 2001) and Ser. No. 09/691,864 (filed Oct. 19, 2000), and in U.S. Pat. No. 6,321,740, which are incorporated herein by reference in their entirety. As disclosed in these documents, a splitting assembly is provided with a plurality of projections that are disposed on at least one side of a splitting line with which a workpiece to be split by the splitting assembly is aligned. The projections are positioned to engage the workpiece during splitting to create an irregular front surface and an irregular upper or lower front edge on the resulting block. As is further disclosed, the projections can be disposed on each side of the splitting line, and projections can be provided on a single splitting assembly, or on each splitting assembly of an opposed pair of splitting assemblies.

A remaining problem arises in a conventional retaining wall with setback courses. In a retaining wall in which each course is setback from the course below, a portion of the upper surface of each block in the lower course is visible between the front face of each block in the lower course and the front face of each block in the adjacent upper course. Typically, the visible upper surface portions are regular and planar which creates the appearance of a ledge between each course. The ledges make the retaining wall less natural looking and are generally thought to detract from the appearance of the retaining wall.

Accordingly, there is a need for equipment and a process that eliminates the regular, planar block top surface located proximate the front face, thereby minimizing the appearance of a ledge when the blocks are stacked into set-back courses. The results should be achieved in a manner that does not slow down the production line, does not add costly equipment to the line, does not require additional space on a production line, is not labor-intensive, and does not have high cull rates when processing blocks with integral locator flanges or other similar features.

SUMMARY OF THE INVENTION

The invention relates to equipment and related methods for producing concrete masonry retaining wall blocks. When a plurality of blocks according to the invention are laid up in a wall with a set-back between each course of blocks in the wall, the appearance of a ledge between the courses of blocks is minimized.

In one aspect of this invention, a splitting assembly for a block splitter is provided that includes means for splitting a workpiece along a splitting line to form at least one block with an irregular front face. An engagement surface is provided on the splitting assembly, disposed adjacent the splitting line on at least one side thereof, and the engagement surface includes a multiplicity of peaks distributed along at least a portion of the length of the splitting line for engaging a surface of the workpiece during a splitting operation to chip and roughen the upper surface along the front face of a block resulting from the splitting of the workpiece. In the preferred embodiment, the splitting line is geometrically linear, that is, a straight line. However, the splitting line could take other forms, such as, for example, arcuate, or serpentine, or composed of a plurality of non-aligned straight segments.

In a preferred embodiment, the means for splitting comprises a block splitter that is secured to a block splitter holder. The engagement surface that includes the multiplicity of peaks is preferably part of the block splitter holder.

In a more preferred embodiment, the block splitter holder is a blade holder and the block splitter is a splitting blade. The block splitter can also be a plurality of projections secured to the holder.

In another aspect of this invention, a block splitting machine that includes a splitting assembly according to the invention is used to split the workpiece to form the block having the chipped and roughened upper surface along the front face.

The invention also relates to a method of producing a masonry block having at least one irregular split edge, an irregular front surface, and a chipped and roughened top surface portion adjacent the front surface. The method includes providing a masonry block splitter having a splitting line with which a masonry workpiece to be split is to be aligned, the block splitter including a first splitting assembly that includes an engagement surface having a multiplicity of peaks disposed on at least one side of the splitting line, with the engagement surface being positioned so that it engages the workpiece at a location corresponding to the top surface portion during the splitting operation. A masonry workpiece is located in the masonry block splitter so that the portion of the workpiece that will become the front face of the finished block is aligned with the splitting line. The workpiece is then split into at least two pieces using the splitting assembly.

A masonry block according to the invention includes a block body having a top surface, a bottom surface, a front surface extending between the top and bottom surfaces, a rear surface extending between the top and bottom surfaces, and side surfaces between the front and rear surfaces. A locator protrusion is formed integrally with the block and disposed on the top or bottom surface. The intersection of the front surface and the top surface defines an upper edge, and the intersection of the front surface and the bottom surface defines a lower edge. The front surface and at least a portion of the upper edge are irregular. In addition, a portion of the top surface adjacent the front surface is chipped and roughened, which results from the multiplicity of peaks of the engagement surface of the splitting assembly engaging the workpiece during the splitting operation.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

The invention relates to the splitting of concrete masonry block workpieces to create a more natural appearance to the faces of concrete retaining wall blocks that result from splitting the workpieces.

Equipment and processes that create a more natural appearing block face and which eliminate the regular, sharp face edges are disclosed in commonly assigned, copending U.S. patent application Ser. No. 09/884,795 (filed Jun. 19, 2001) and Ser. No. 09/691,864 (filed Oct. 19, 2000), and in U.S. Pat. No. 6,321,740, which are incorporated herein by reference in their entirety. As disclosed in these documents, a splitting assembly is provided with a plurality of projections that are disposed on at least one side of a splitting line with which a workpiece to be split by the splitting assembly is aligned. The projections are positioned to engage the workpiece during splitting to create an irregular front surface and an irregular upper or lower front edge on the resulting block. A typical workpiece that is split is formed by two blocks molded from no-slump concrete in a face-to-face arrangement so that splitting of the workpiece creates irregular front faces on both blocks.

Figure 1:
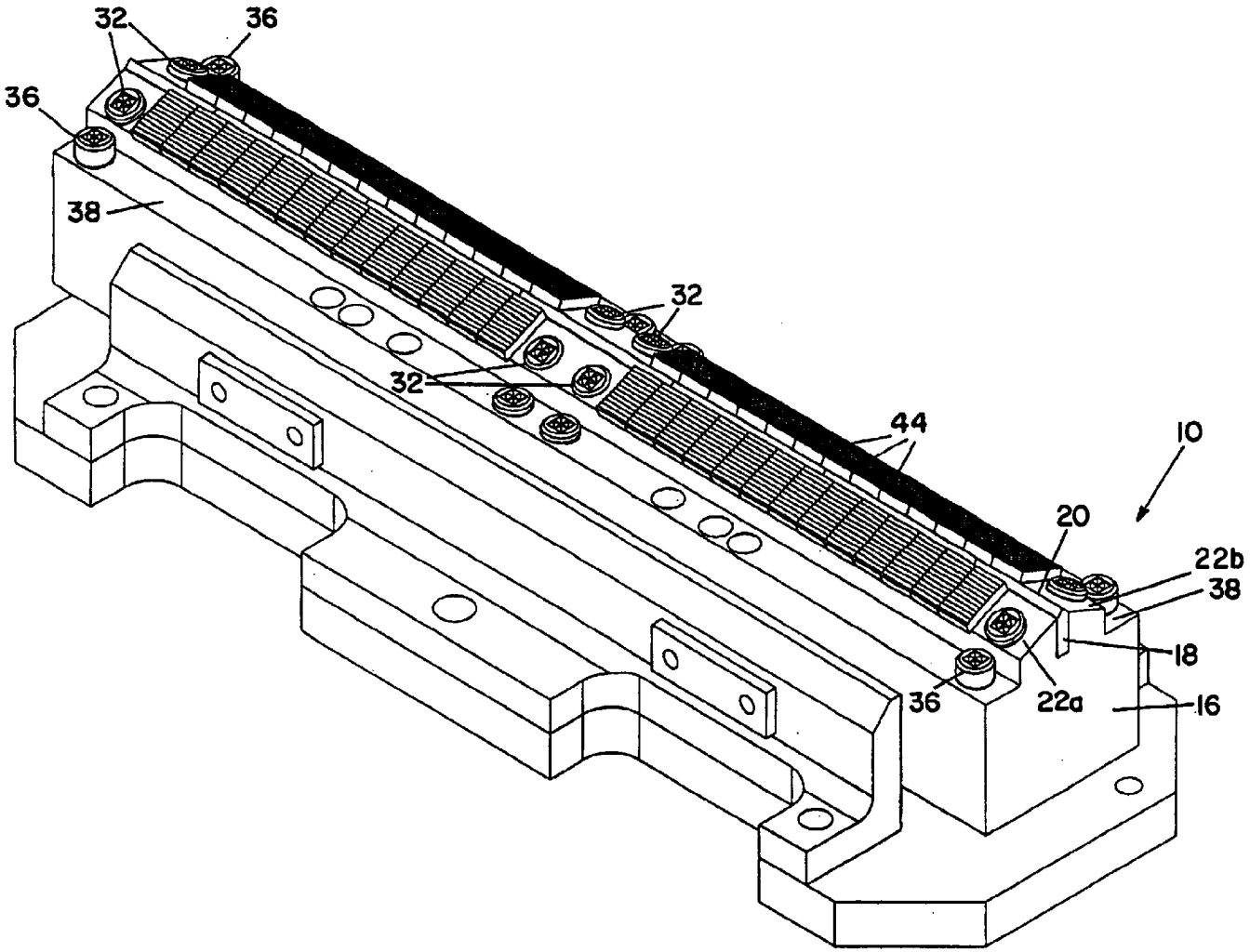
FIG. 1 is a perspective view of a bottom splitting assembly of the invention for use in a block splitting machine.

Attention is now directed to the figures where like parts are identified with like numerals through several views. FIG. 1 illustrates a first or bottom splitting assembly 10 in accordance with the present invention. The bottom splitting assembly 10 is used in a block splitting machine which includes a second or top splitting assembly 12 positioned opposite the bottom splitting assembly 10 (see FIG. 3). Block splitting machines suitable for utilizing the bottom and top splitting assemblies 10, 12 so as to practice the present invention may be obtained from Lithibar Co., located in Holland, Mich. and other equipment manufacturers. When referring to the splitting apparatus, the terms "bottom", "top", "upper", and "lower" refer to the position of the splitting assemblies relative to the workpiece during splitting. The workpiece is preferably oriented "lips up" during splitting. This "lips up" orientation allows the workpiece to lay flat on what will be the upper surface of the resulting block(s) when it is laid in a wall.

Figure 2:
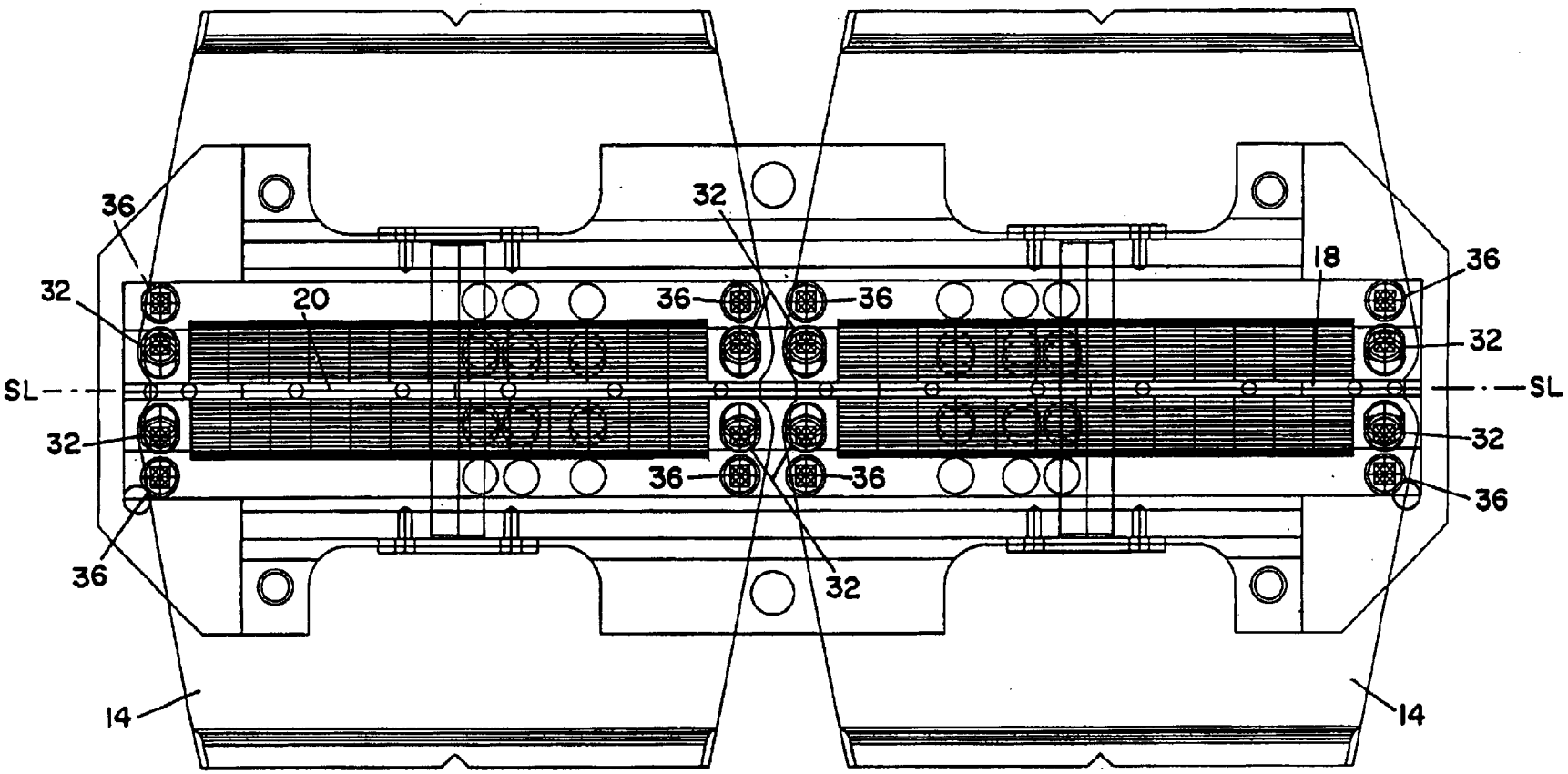
FIG. 2 is a top plan view of the bottom splitting assembly shown in relation to a workpiece that is to be split.

The splitting assembly 10 is adapted to move upwardly through an opening in a support table (not shown), in a manner known in the art, to engage one or more workpieces 14 during the splitting operation, and to move downwardly through the opening after completion of the splitting operation so that the split pieces can be removed from the splitting machine and one or more subsequent workpieces can be positioned in the splitting machine aligned with the splitting line SL (see FIG. 2).

Figure 3:
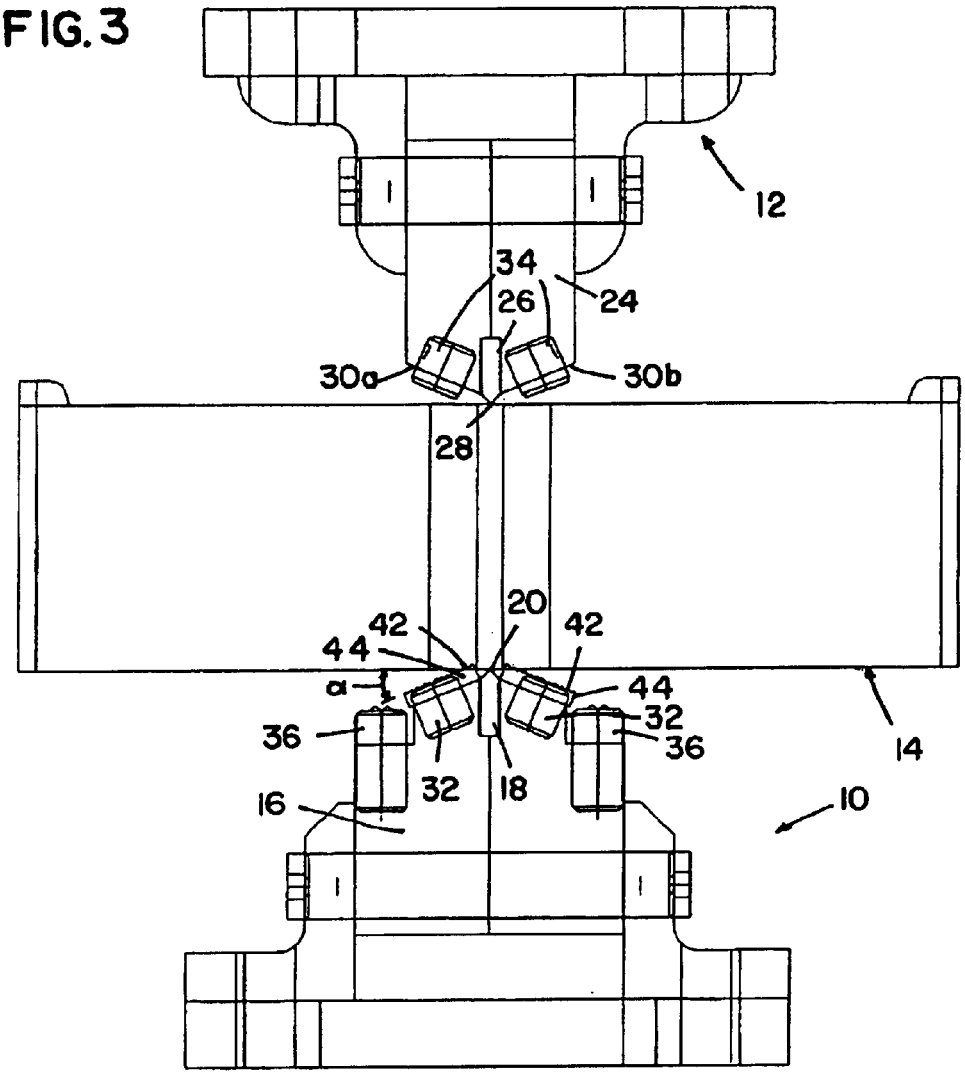
FIG. 3 is an end view of the bottom splitting assembly and a top splitting assembly positioned to split a workpiece.

With reference to FIGS. 1 and 3, the splitting assembly 10 is seen to include a block splitter holder 16 having a block splitter 18 secured thereto, which together form means for splitting the workpiece 14. In the embodiment illustrated, the holder 16 comprises a blade holder, and the block splitter 18 comprises a splitting blade. For sake of convenience, the invention will hereinafter be described by referring to "blade holder 16" or "holder 16" and "splitting blade 18" or "blade 18". However, it is to be realized that the holder 16 and the splitter 18 could be formed by structures other than those illustrated in the figures. Further, the block splitter could also be in the form of projections (described below).

The blade 18 includes a central cutting edge 20. As is evident from FIG. 2, the central cutting edge 20 extends parallel to and defines the splitting line SL along which the workpiece(s) will be split. In the preferred embodiment, the splitting line SL is a straight line, and the resulting split face of the block will be generally planar as a result. However, the splitting line could take on other configurations, such as, for example, curved, if desired. The blade holder 16 includes engagement surfaces 22*a*, 22*b* extending outwardly from the blade 18.

Likewise, as seen in FIG. 3, the top splitting assembly 12 includes a blade holder 24 having a blade 26 that includes a central cutting edge 28. The central cutting edge 28 extends parallel to the cutting edge 20 along the splitting line SL. The blade holder 24 includes engagement surfaces 30*a*, 30*b* extending outwardly from the blade 26.

The engagement surfaces 22*a*, 22*b*, 30*a*, 30*b* extend away from the blades 18, 26, respectively, at relatively shallow angles, so that, during a splitting operation, the surfaces 22*a*, 22*b*, 30*a*, 30*b* will engage the workpiece(s). This engagement breaks the split edges of the resulting split pieces in a random fashion. The irregular breaking action can be enhanced by placing workpiece-engaging projections on the engagement surfaces 22*a*, 22*b*, 30*a*, 30*b* as desired. The engagement surfaces 22*a*, 22*b*, 30*a*, 30*b* are preferably oriented at an angle $\alpha$ between about 0° and about 30° relative to horizontal, most preferably about 23°.

The splitting assemblies 10, 12 also include workpiece-engaging projections 32, 34 on the engagement surfaces 22*a*, 22*b*, 30*a*, 30*b*, respectively, that are adjustable and removable. In this way, the same blade assemblies can be used for splitting different workpiece configurations by changing the number, location, spacing and height of the projections. The projections 32, 34 are preferably threaded into corresponding threaded openings in the engagement surfaces 22*a*, 22*b*, 30*a*, 30*b* for adjustment, although other height adjustment means could be employed. However, during a splitting action, the projections, the blades and the blade holders are in a fixed relationship relative to each other, whereby as the blade holder moves, the projections associated with the blade and blade holder move simultaneously therewith.

The projections 32, 34 in this embodiment are preferably made of a carbide-tipped metal material. In addition, the top surfaces of the projections 32, 34 are jagged, comprising many pyramids in a checkerboard pattern. Projections such as these can be obtained from Fairlane Products Co. of Fraser, Mich. It will be understood that a variety of other projection top surface configurations could be employed. The height of the top surface of the projections is preferably about 0.040 inches below the cutting edges 20, 28 of the blades 18, 26. However, the projections may extend further below, or some distance above, the top of the blades 18, 26, within the principles of the invention. The projections shown are about 0.75 inch diameter with a 10 thread/inch pitch, and are about 1.50 inches long. Diameters between about 0.50 and about 1.0 inch are believed preferable. The loose block material from the splitting process entering the threads, in combination with the vertical force of the splitting strikes, are considered sufficient to lock the projections in place.

However, other mechanisms could be used to lock the projections in place relative to the blades during the splitting process.

The blades 18, 26 and the projections 32, 34 are wear locations during the splitting process. The removable mounting of the projections 32, 34 permits the projections to be removed and replaced as needed due to such wear. It is also preferred that the blades 18, 26 be removable and replaceable, so that as the blades wear, they can be replaced as needed. The blades 18, 26 can be secured to the respective blade holders 16, 24 through any number of conventional removable fastening techniques, such as by bolting the blades to the blade holders, with each blade being removably disposed within a slot formed in the respective blade holder as shown in FIG. 3. The blades could also be integrally formed with the respective blade holder if desired.

The bottom splitting assembly 10 also includes adjustable and removable workpiece-engaging projections 36 extending vertically upward from horizontal shoulders 38, as shown in FIGS. 1–3. The projections 36 are similar in construction to the projections 32, 34, although the projections 36 can be larger or smaller in size than the projections 32, 34, depending upon the desired effect to be achieved.

The angling of the projections 32, 34 on the engagement surfaces 22*a*, 22*b*, 30*a*, 30*b* of the blade holders 16, 24 allows the projections 32, 34 to gouge into the workpiece(s) and break away material primarily adjacent the bottom and top edges of the resulting block, however without breaking away too much material. The bottom splitting assembly 10 typically contacts the workpiece 14 after the top splitting assembly 12 has begun its splitting action. The initial splitting action of the top splitting assembly 12 can force the resulting split pieces of the workpiece 14 away from each other before the bottom splitting assembly 10 and the angled projections 32 can fully complete their splitting action. However, the vertical projections 36 on the shoulders 38 of the blade holder 16 help to hold the split pieces in place to enable the angled projections 32 to complete their splitting action. The vertical projections 36 also break away portions of the split pieces adjacent the top edges of the resulting block(s).

The splitting assemblies 10, 12 and the features thereof described so far are disclosed in one or more of U.S. patent application Ser. Nos. 09/884,795 and 09/691,864, and U.S. Pat. No. 6,321,740.

The projections 32, 34, 36 of the splitting assemblies 10, 12 are located so that material is broken away primarily from portions of the resulting block(s) that correspond to the top and bottom, left and right front corners thereof. (When referring to the resulting blocks, the terms "top", "bottom", "upper", and "lower" refer to the blocks as they will be laid in a wall.) Breaking of the top and bottom edges between the front corners results primarily through engagement with the surfaces 22*a*, 22*b*, 30*a*, 30*b*.

With reference to FIGS. 1–3, the appearance of the finished block can also be enhanced by modifying the engagement surfaces 22*a*, 22*b* between the projections 32 so that the engagement surfaces 22*a*, 22*b* chip and roughen a portion of the upper surface of the block near the front face. This will minimize the appearance of a ledge when the blocks are stacked into set-back courses. The surface modifications should be such as to result in additional concrete material being chipped away when the engagement surfaces 22*a*, 22*b* contact the workpiece to roughen the ledge area of the upper surface of the block. The surface modifications preferably comprise a multiplicity of peaks formed on the engagement surfaces 22*a*, 22*b* between the projections 32.

Figure 3A:
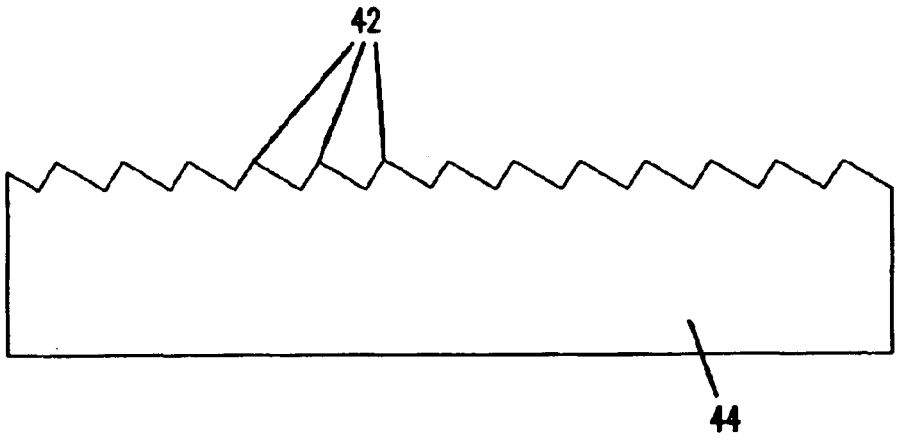
FIG. 3A is a detailed side view of a pad that defines the ridges and valleys of the engagement surfaces.

In the preferred embodiment, the peaks are in the form of a plurality of ridges 42 extending parallel to the cutting edge 20 of the blade 18, with valleys or grooves defined between adjacent ridges 42. As seen in FIGS. 3 and 3A, the alternating ridges 42 and valleys provide the engagement surfaces 22*a*, 22*b* with a generally serrated or saw-toothed appearance when viewed from the end. The ridges 42 are preferably angled in a direction toward the workpiece 14, and preferably have sharp tips. Alternatively, the ridges 42 can have radiused tips, although the resulting distressing action will generally be less than that achieved using sharp tips. The ridges 42 and valleys can be used alone, or in combination with the projections 32, 36.

The ridges 42 preferably extend from adjacent the blade 18 across the entire width of the engagement surfaces 22*a*, 22*b*, and for each workpiece 14, preferably extend along substantially the entire length of the engagement surfaces 22*a*, 22*b* between the projections 32. Depending upon the result one wishes to achieve on the resulting blocks, the ridges 42 can extend along only portions of the engagement surfaces 22*a*, 22*b* between the projections 32. In addition, depending upon how much of the upper surface of the block is to be chipped and roughened, the ridges 42 can extend across portions of the width of the engagement surfaces 22*a*, 22*b*, rather than their entire width.

In the embodiment illustrated in FIGS. 1–3, the ridges 42 are formed on pads or tiles 44, and a plurality of the pads 44 are lined up next to each other and secured to the blade holder 16 to form the continuous ridges and valleys of the engagement surfaces 22*a*, 22*b*. A side view of a pad 44 is shown in FIG. 3A. The pads or tiles 44 are preferably made from carbide material. Pads such as these can be obtained from Fairlane Products Co. of Fraser, Mich. Rather than using a plurality of individual pads, it is contemplated that a single plate having a length equal to the plurality of pads, and having the ridges 42 and valleys formed therein, could be used. Further, it is contemplated that, rather than using pads 44, the ridges and valleys could be formed directly in the blade holder 16.

As an alternative to ridges 42, the peaks could comprise a plurality of pyramids arranged in a checkerboard pattern on the engagement surfaces 22*a*, 22*b*, similar to the top surfaces of the projections 32, 34.

The pads 44 are wear locations during the splitting process. Therefore, it is preferred that the pads 44 be removably mounted to the blade holder 16 using any number of conventional removable fastening techniques, such as bolting the pads to the holder 16. Adhesive could also be used as long as the adhesive allows removal of the pads. With the pads 44 in place, the angle $\alpha$ is preferably between about 15 to 23 degrees relative to horizontal (see FIG. 3). The highest point of the pads 44 can either be below or above the cutting edge 20 of the blade 18. Preferably, the highest point of the pads is between about 0.125 inches below and about 0.125 inches above the cutting edge 20.

Figure 4:
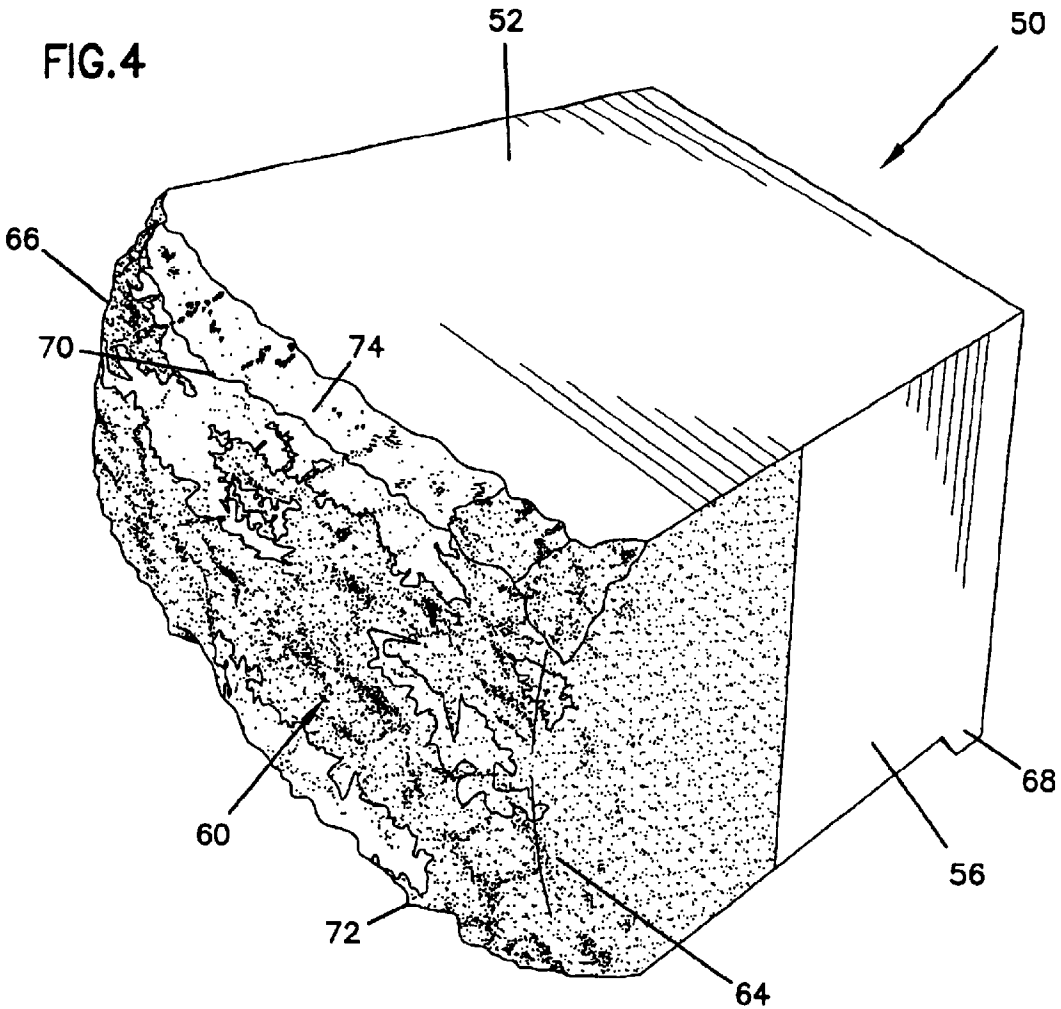
FIG. 4 is a perspective view of a masonry block that is split from a workpiece using top and bottom splitting assemblies of the type illustrated in FIG. 3.
Figure 5:
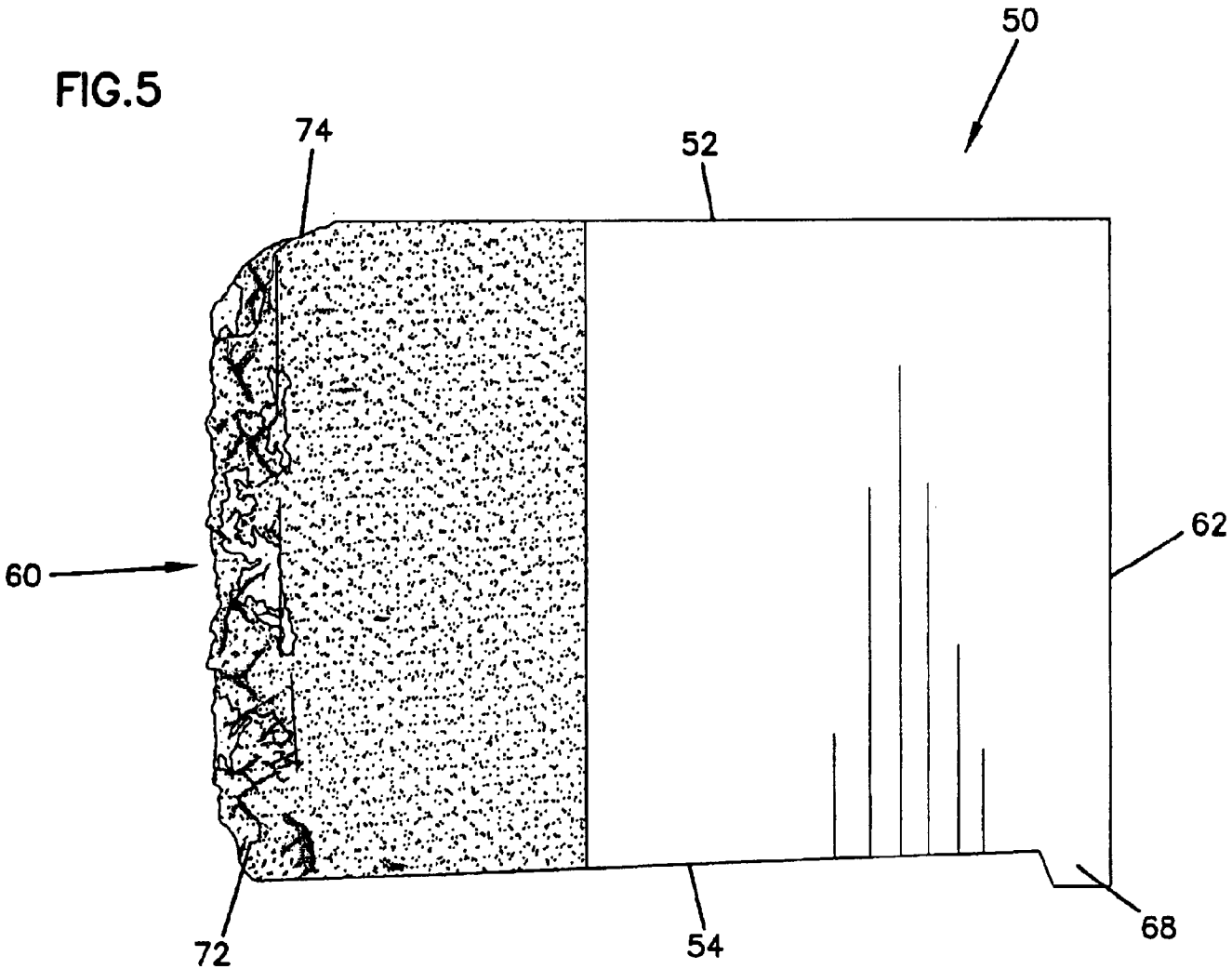
FIG. 5 is a side view of the masonry block of FIG. 4.

A block 50 that results from splitting the workpiece 14 using the bottom and top splitting assemblies in FIG. 3 is illustrated in FIGS. 4 and 5. The block 50 includes a block body with a generally planar top surface 52, a generally planar bottom surface 54, side surfaces 56 (only one side surface is visible in FIGS. 4 and 5), a front surface 60 and a rear surface 62. In addition, the front surface 60 of the block 50 is connected to the side surfaces 56 by radiused sections 64, 66. Due to the positioning of the projections 32, 34 on the splitting assemblies 10, 12 (best seen in FIG. 2), the upper left and right corners and the lower left and right corners of the block 50 at the radiused sections 64, 66 are broken away during the splitting process.

The block 50 includes a locator lip or flange 68 formed integrally on the bottom surface 54 adjacent to, and preferably forming a portion of, the rear surface 62. The lip 68 establishes a uniform set back for a wall formed from the blocks 50, and provides some resistance to shear forces. In the preferred configuration, the lip 68 is continuous from one side of the block 50 to the other side. However, the lip 68 need not be continuous from one side to the other side, nor does the lip 68 need to be contiguous with the rear surface 62. A different form of protrusion that functions equivalently to the lip 68 for locating the blocks could be used.

In the block of FIGS. 4 and 5, the top and bottom surfaces 52, 54 do not have to be planar, but they do have to be configured so that, when laid up in courses, the block tops and bottoms in adjacent courses stay generally parallel to each other. Further, the front surface 60 of each block is wider than the rear surface 62, which is achieved by angling at least one of the side surfaces 56, preferably both side surfaces, so that the side surfaces get closer together (converge) as they approach the rear surface. Such a construction permits inside radius walls to be constructed. It is also contemplated that the side surfaces 56 can start converging from a position spaced rearwardly from the front surface 60. This permits adjacent blocks to abut slightly behind the front face along regular surfaces that have not been altered by the action of the splitter, engagement surfaces, or projections, which in turn, means that it is less likely that fine materials behind the wall can seep out through the face of the wall.

The front surface 60 of the block has an irregular, rock-like texture. In addition, an upper edge 70 and a lower edge 72 of the front surface 60 are also irregular as a result of the splitting assemblies 10, 12.

In addition, the ridges 42 on the engagement surfaces 22*a*, 22*b* of the bottom splitting assembly 10 chip and roughen a portion 74 of the top surface 52 of the block 50 adjacent the upper edge 70 and front face 60 of the block. The chipped and roughend portion 74 helps to minimize the appearance of a ledge when a plurality of similar blocks 50 are laid up in a wall 100 with a set-back between each course of blocks in the wall 100 (see FIG. 6). The upper edge 70 of the block 50 is also slightly rounded as a result of the ridges and grooves 42.

Figure 6:
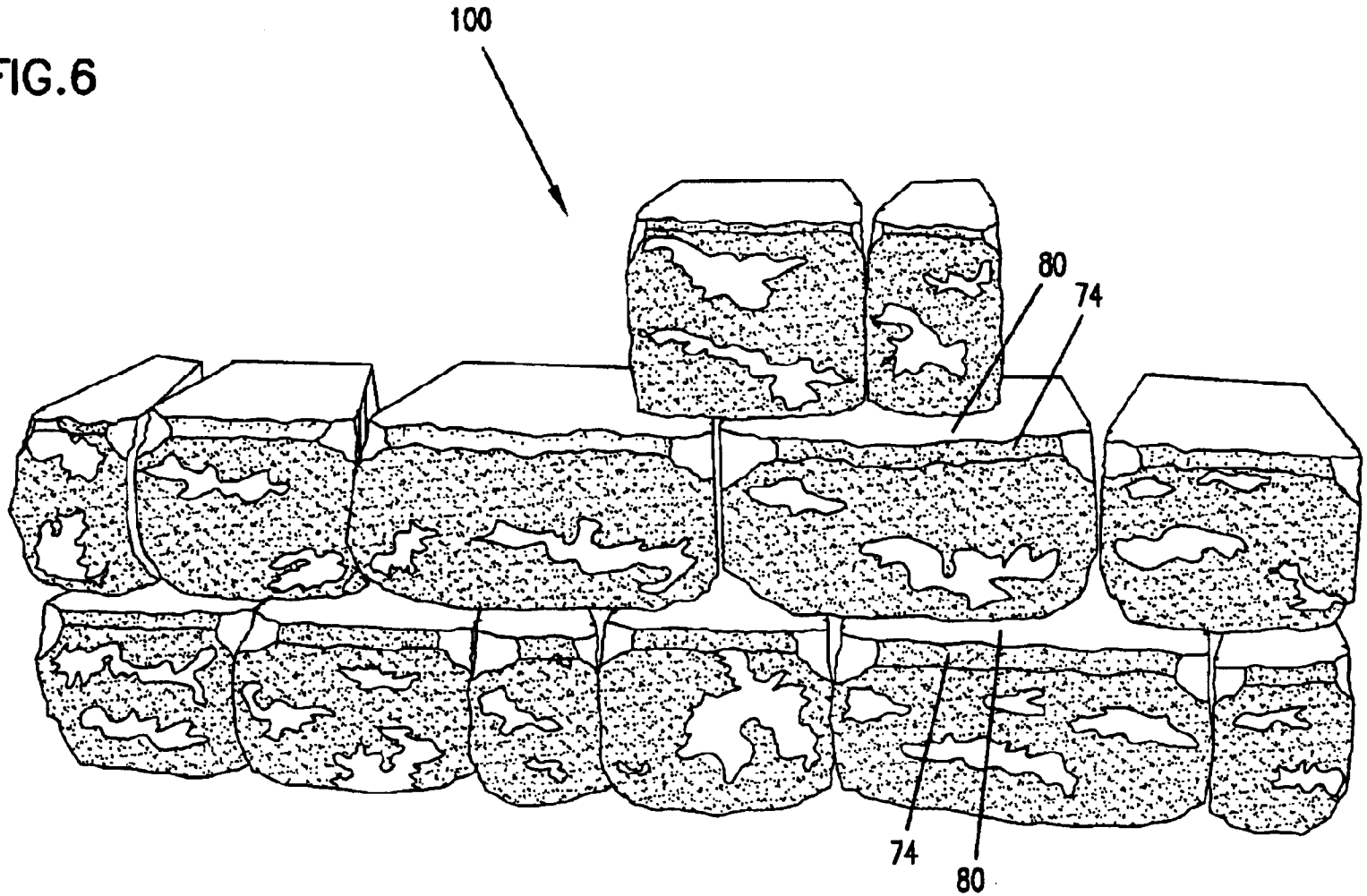
FIG. 6 illustrates a wall constructed from a plurality of blocks of FIG. 4.

FIG. 6 illustrates a wall 100 constructed from a plurality of the blocks 50. The ridges 42 and valleys on the engagement surfaces 22*a*, 22*b* of the bottom splitting assembly 10 create the chipped and roughened portions 74 on the top surfaces 52 of the blocks 50. Since each course is setback from the course below, a portion 80 of the top surface 52 of each block 50 in the lower course is visible between the front surface 60 of each block 50 in the lower course and the front surface 60 of each block in the adjacent upper course. In the absence of the treatment described herein, the entire portion 80 is regular and planar which creates the appearance of a ledge between each course. However, as a result of the action of the ridges 42, the chipped and roughened portions 74 of the visible portions 80 are irregular and non-planar, thereby minimizing the appearance of the ledge and making the wall 100 and the blocks 50 from which it is formed appear more natural.

Figure 7:
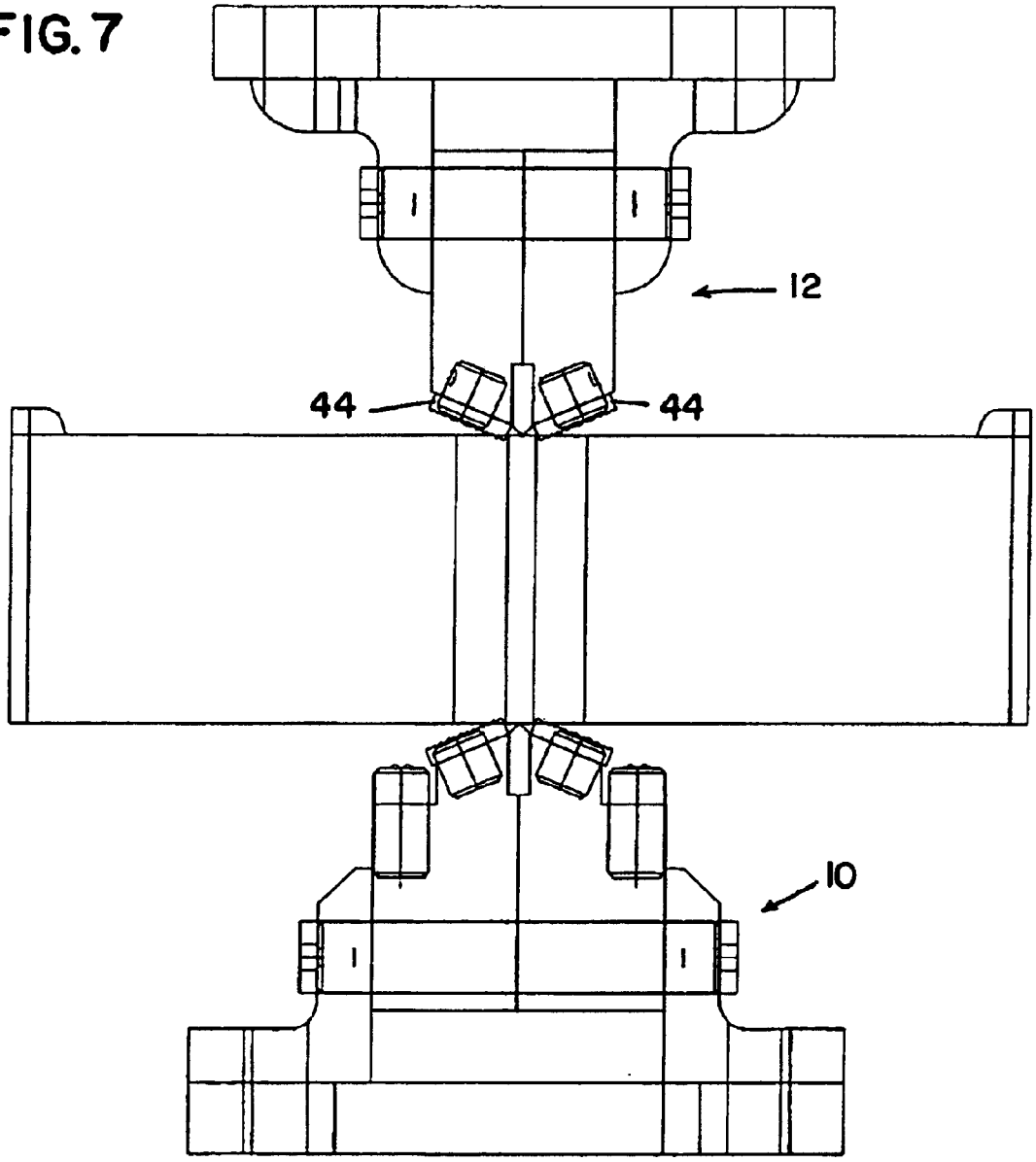
FIG. 7 is an end view of the bottom splitting assembly and an alternative embodiment of a top splitting assembly positioned to split a workpiece.

With reference to FIG. 7, the engagement surfaces 30*a*, 30*b* of the top splitting assembly 12 are shown as including pads or tiles 44. The pads 44 are preferably identical to the pads used on the bottom splitting assembly 10, so that the engagement surfaces 30*a*, 30*b* have a multiplicity of peaks in the form of alternating-ridges and valleys or grooves. However, the surface modifications on the engagement surfaces 30*a*, 30*b* could be different than the surface modifications provided on the engagement surfaces 22*a*, 22*b*. The use of peaks on the top splitting assembly 12, in addition to those on the bottom splitting assembly 10, help to round the front face of the block from top to bottom. In addition, the front face appears more uniform.

Figure 8:
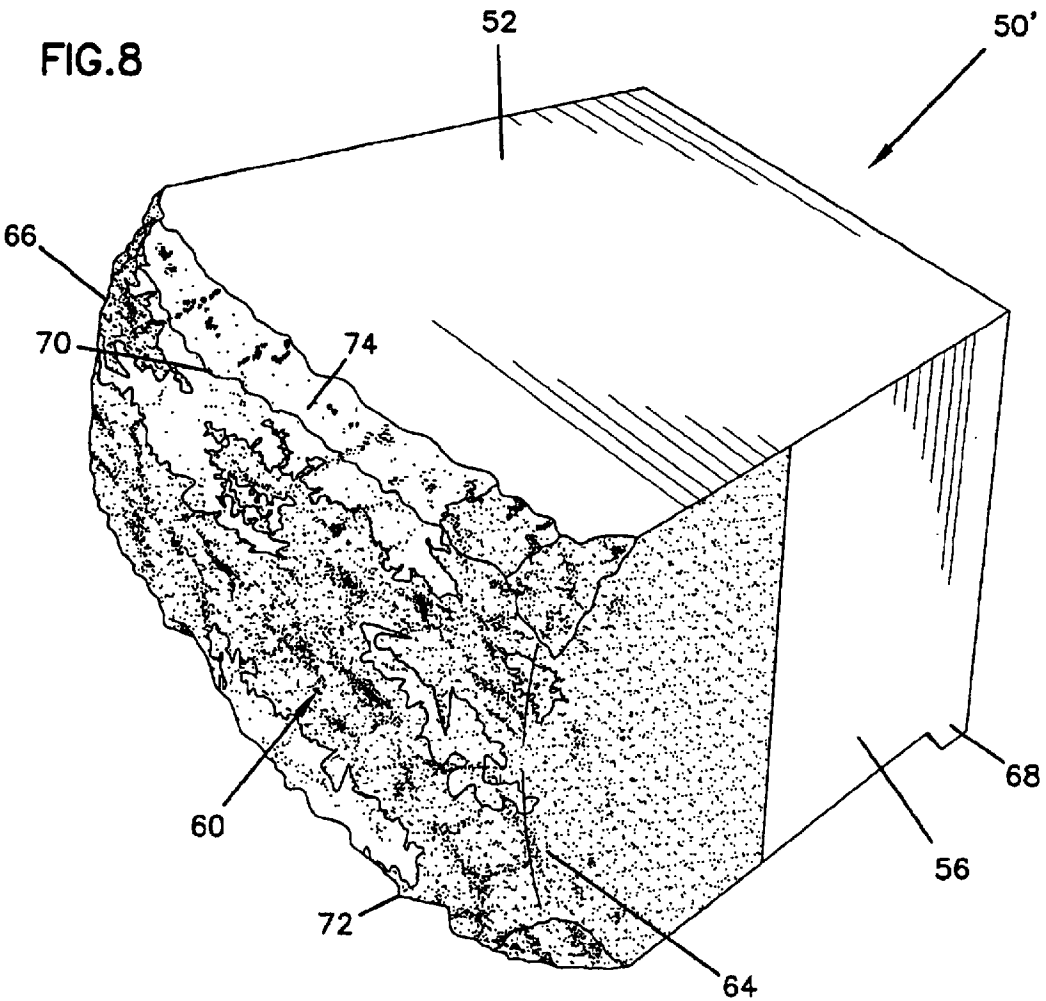
FIG. 8 is a perspective view of a masonry block that is split from a workpiece using top and bottom splitting assemblies of the type illustrated in FIG. 7.
Figure 9:
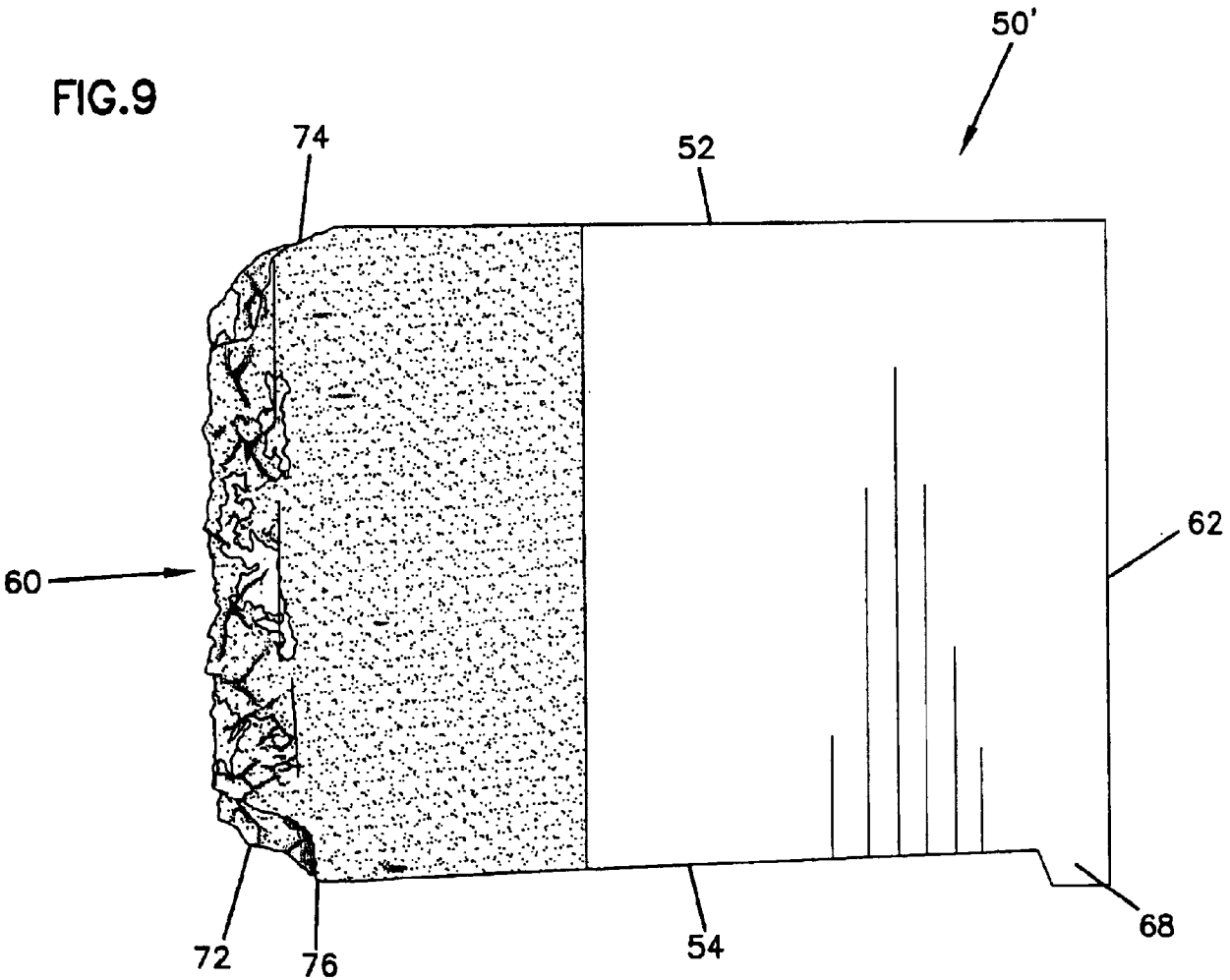
FIG. 9 is a side view of the masonry block of FIG. 8.
Figure 10:
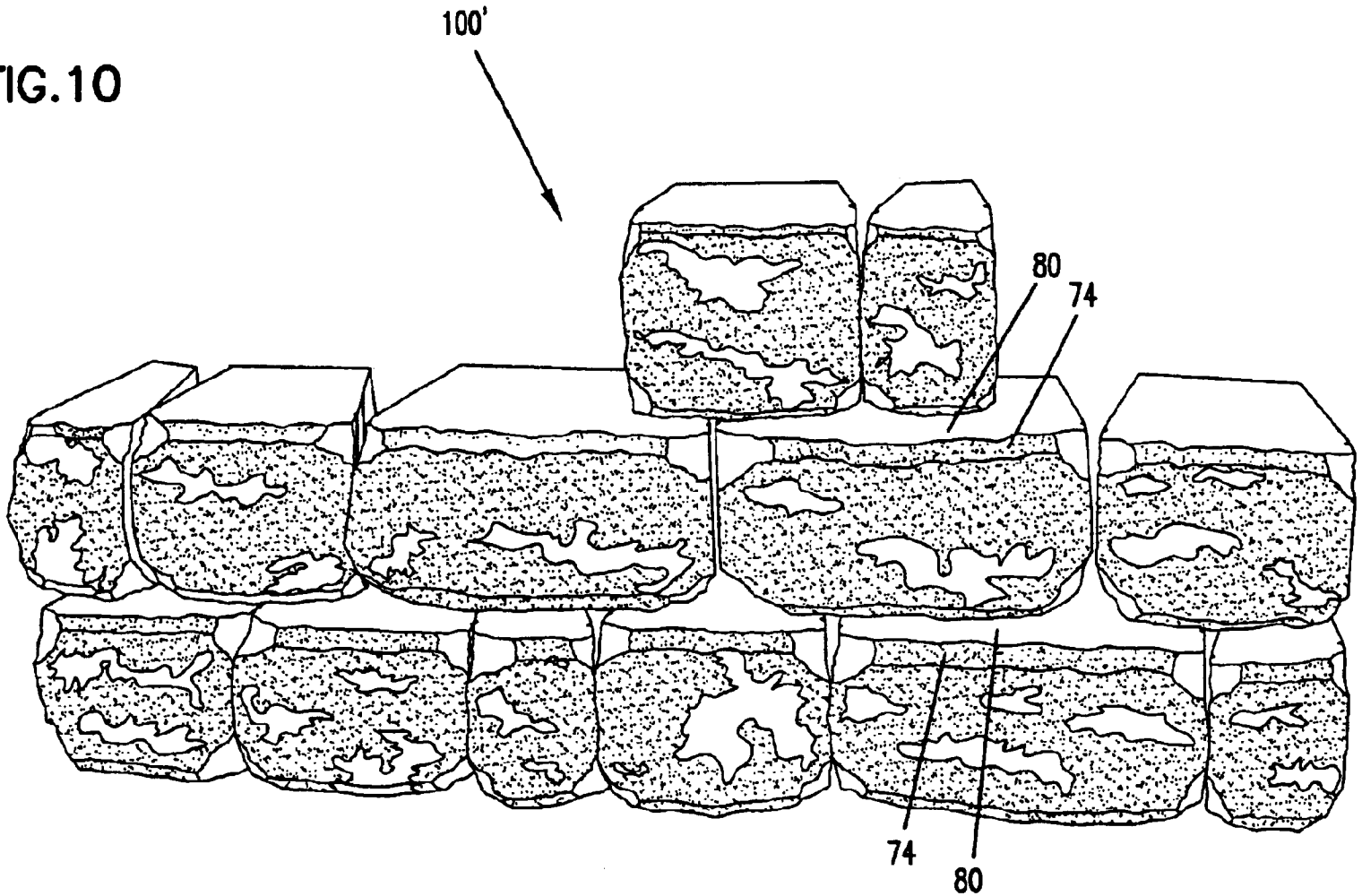
FIG. 10 illustrates a wall constructed from a plurality of blocks of FIG. 8.

A block 50' that results from splitting the workpiece using the bottom and top splitting assemblies in FIG. 7 is illustrated in FIGS. 8 and 9. Due to the peaks on the top splitting assembly 12, a portion 76 of the block bottom surface 54 adjacent the bottom edge 72 is chipped and roughened and the bottom edge 72 is also slightly rounded, as illustrated in FIGS. 8 and 9. A wall 100' that is constructed from a plurality of the blocks 50' is illustrated in FIG. 10.

In either block 50 or 50', the front face 60 can be mottled or variegated, and the radiused sections 64, 66 and at least a portion of the side surfaces 56 can be lightly textured, as disclosed in copending application Ser. No. 09/884,795. Preferably, the entire length of the side surfaces 56 is lightly textured.

There may be instances when it is satisfactory that a block be provided with only one irregular edge on the front face and with only a chipped and roughened top surface portion. Therefore, it is contemplated and within the scope of the invention that a workpiece could be split using a single one of the splitting assemblies described herein. Further, a splitting assembly could have engamenet surface enhancements on only one side of the splitting line, and have projections that are disposed on only one side of the splitting line. Still further, a splitting assembly could use engagement surface enhancements without using projections.

It is further contemplated and within the scope of the invention that a workpiece could be split into a single block and one or more waste pieces. In this case, the engagement surface enhancements and the projections (if used) on the bottom and top splitting assemblies would be disposed on the same side of the splitting line for each splitting assembly.

Moreover, it is contemplated and within the scope of the invention that the splitting assemblies could be used without the blades 18, 26.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A splitting assembly for a block splitting machine, comprising:

a block splitter defining a splitting line, the block splitter being configured to split a workpiece that is positioned in the block splitting machine aligned with the splitting line to form at least one block with an irregular front face;

a multiplicity of peaks adjacent said splitting line on at least one side thereof, that engage a surface of the workpiece during a splitting operation, said multiplicity of peaks including a multiplicity of peaks extending over a distance parallel to said splitting line and a multiplicity of peaks extending over a distance away from said splitting line, the tips of the peaks that are further from said splitting line being further from the workpiece when the splitting assembly is in its rest position prior to a splitting operation, and said multiplicity of peaks chip and roughen the workpiece surface and round the edge of the block at the intersection of the workpiece surface and the front face of said at least one block during the splitting operation, said multiplicity of peaks being configured and positioned to engages the workpiece so that the majority of the length of the edge along the front face of the resulting block is chipped and roughened the length of the edge along the front face of the resulting block is chipped and roughened.

2. The splitting assembly of claim 1, wherein said multiplicity of peaks are in the form of alternating ridges and valleys.

3. The splitting assembly of claim 2, wherein said ridges have sharp tips.

4. The splitting assembly of claim 2, wherein the ridges and valleys extend at least substantially the entire length of the front face of the resulting block.

5. The splitting assembly of claim 2, wherein the ridges and valleys are generally parallel to the splitting line.

6. The splitting assembly of claim 1, wherein said block splitter comprises a splitting blade.

7. The splitting assembly of claim 6, wherein said blade has a straight splitting edge defining a straight splitting line.

8. The splitting assembly of claim 1, wherein said splitting assembly comprises a multiplicity of peaks on each side of the splitting line.

9. The splitting assembly of claim 1, wherein the peaks have tips that lie generally on a plane that is at an acute angle relative to horizontal.

10. The splitting assembly of claim 9, wherein said acute angle is between about 0 degrees to about 30 degrees.

11. The splitting assembly of claim 1, wherein the workpiece surface is the bottom surface workpiece.

12. The splitting assembly of claim 1, further comprising a plurality of workpiece-engaging projections adjacent the splitting line on the side thereof containing the multiplicity of peaks, the projections being positioned relative to the workpiece to break away material from portions of the workpiece corresponding to the top or bottom front corners of the resulting block.

13. A splitting assembly for a block splitting machine, comprising:

a block splitter defining a splitting line, the block splitter being configured to split a workpiece that is positioned in the block splitting machine aligned with the splitting line to form at least one block with an irregular front face;

a multiplicity of peaks adjacent the splitting line on at least one side thereof that extend over a distance generally parallel to the splitting line and extend a distance away from the splitting liner wherein the multiplicity of peaks engage a surface of the workpiece adjacent and over a distance generally parallel to the splitting line and over a distance extending away from the splitting line during a splitting operation to chip and roughen the workpiece surface and round the edge of the block at the intersection of the workpiece surface and the front face of the block, said multiplicity of peaks being configured and positioned to engage the workpiece surface so that the majority of the length of the edge along the front face of the resulting block is chipped and roughened.

14. The splitting assembly of claim 13, wherein the multiplicity of peaks in the of alternating valleys.

15. The splitting assembly of claim 14, wherein the ridges and valleys are generally parallel to the splitting line.

16. The splitting assembly of claim 14, wherein the ridges have sharp tips.

17. The splitting assembly of claim 14, wherein the ridges and valleys extend at least substantially the entire length of the front face of the resulting block.

18. The splitting assembly of claim 13, wherein the block splitter comprises a splitting blade.

19. The splitting assembly of claim 18, wherein the blade has a straight splitting edge defining a straight splitting line.

20. The splitting assembly of claim 13, wherein the splitting assembly comprises a multiplicity of peaks on each side of the splitting line.

21. The splitting assembly of claim 13, further comprising a plurality of workpiece-engaging projections adjacent the block splitter on the side thereof containing the multiplicity of peaks, the projections being positioned relative to the workpiece to break away material from portions of the workpiece corresponding to the top or bottom front corners of the resulting block.

22. The splitting assembly of claim 13, wherein the peaks have tips that lie generally on a plane that is at an acute angle relative to horizontal.

23. The splitting assembly of claim 22, wherein the acute angle is between about 0 degrees to about 30 degrees.

24. The splitting assembly of claim 13, wherein the workpiece surface is the bottom surface of the workpiece.

25. A splitting assembly for a block splitting machine, comprising:

a block splitter defining a splitting line, the block splitter being configured to split a workpiece that is positioned in the block splitting machine aligned with the splitting line to form at least one block with an irregular front face;

a multiplicity of peaks adjacent the splitting line on at least one side thereof that engage a surface of the workpiece during a splitting operation, and wherein the peaks are configured and arranged to chip and roughen the workpiece surface engaged thereby adjacent to, and over a distance generally parallel to, at least a portion of the splitting line and for a distance extending away from the splitting line and to round the edge of the block at the intersection of the workpiece surface and the front face of the block, said multiplicity of peaks being configured and positioned to engage the workpiece surface so that the majority of the length of the edge along the front face of the resulting block is chipped and roughened.

26. The splitting assembly of claim 25, wherein the multiplicity of peaks are in the form of alternating ridges and valleys.

27. The splitting assembly of claim 26, wherein the ridges and valleys are generally parallel to the splitting flue.

28. The splitting assembly of clam 26, wherein the ridges have sharp tips.

29. The splitting assembly of claim 26, wherein the ridges and valleys extend at least substantially the entire length of the front face of the resulting block.

30. The splitting assembly of claim 25, wherein the block splitter comprises a splitting blade.

31. The splitting assembly of claim 30, wherein the blade has a straight splitting edge defining a straight splitting line.

32. The splitting assembly of claim 25, wherein the splitting assembly comprises a multiplicity of peaks on each side of the splitting line.

33. The splitting assembly of claim 25, further comprising a plurality of workpiece-engaging projections adjacent the block splitter on the side thereof containing the multiplicity of peaks, the projections being positioned relative to the workpiece to break away material from portions of the workpiece corresponding to the top or bottom front corners of the resulting block.

34. The splitting assembly of claim 25, wherein the the peaks have tips that lie generally on a plane that is at an acute angle relative horizontal.

35. The splitting assembly of claim 34, wherein the acute angle is between about 0 degrees to about 30 degrees.

36. The splitting assembly of claim 25, wherein the workpiece surface is the bottom surface of the workpiece.

* * * * *

UNITED STATES PATENT AND TRADEMARK OFFICE

CERTIFICATE OF CORRECTION

PATENT NO. : 6,874,494 B2
DATED : April 5, 2005
INVENTOR(S) : Scherer et al.

It is certified that error appears in the above-identified patent and that said Letters Patent is hereby corrected as shown below:

Column 10,
Line 67, delete "engages" and insert -- engage --.

Column 11,
Line 3, after "roughened" insert -- . -- and delete "the length of the edge along the front face of the resulting block is chipped and roughened.";
Line 27, after "surface" (2nd occurrence) insert -- of --;
Line 44, delete "liner" and insert -- line, --.

Signed and Sealed this

Sixteenth Day of May, 2006

JON W. DUDAS
*Director of the United States Patent and Trademark Office*